United States Patent [19]

Schlough

[11] Patent Number: 4,988,086

[45] Date of Patent: Jan. 29, 1991

[54] APPARATUS AND METHOD FOR FORMING SHEET MATERIAL ASSEMBLAGES

[75] Inventor: James R. Schlough, Troy, Ohio

[73] Assignee: AM International Incorporated, Chicago, Ill.

[21] Appl. No.: 302,826

[22] Filed: Jan. 26, 1989

[51] Int. Cl.[5] ..... B65H 5/30

[52] U.S. Cl. ..... 270/55; 270/54

[58] Field of Search ..... 270/52, 54, 55, 56, 270/57, 58

[56] References Cited

U.S. PATENT DOCUMENTS

| | | | |
|---|---|---|---|
| 2,461,573 | 2/1949 | Schweizer . | |
| 4,127,262 | 11/1978 | Eberle et al. . | |
| 4,133,521 | 1/1979 | Muller | 270/55 |
| 4,403,770 | 9/1983 | Ferguson et al. . | |
| 4,477,067 | 10/1984 | Wise | 270/55 |
| 4,533,132 | 8/1985 | Wangermann | 270/55 |
| 4,723,770 | 2/1988 | Seidel et al. . | |
| 4,743,005 | 5/1988 | Reist | 270/55 |

FOREIGN PATENT DOCUMENTS

| | | | |
|---|---|---|---|
| 1395576 | 5/1988 | U.S.S.R. | 270/58 |

*Primary Examiner*—Edward K. Look
*Assistant Examiner*—Therese M. Newholm
*Attorney, Agent, or Firm*—Tarolli, Sundheim & Covell

[57] ABSTRACT

An apparatus for forming sheet material assemblages includes a plurality of sheet material assemblers which travel in a continuous path and sequentially pass beneath stacks of sheet material. The stacks of sheet material are disposed in bottomless hoppers. The sheet material assemblers include belts which support the stacks of sheet material in the bottomless hoppers. The belts move with the sheet material assemblers to sequentially engage the stacks of sheet material. Upper runs of the belts move in opposite directions to the sheet material assemblers and at the same speed as the sheet material assemblers so that the upper runs of the belts are stationary relative to the stacks of sheet material. The sheet material assemblers also include feed mechanisms and receiving locations. As a sheet material assembler passes under a stack of sheet material, sheet material is fed from the stack of sheet material by a feed mechanism to a receiving location.

68 Claims, 8 Drawing Sheets

APPARATUS AND METHOD FOR FORMING SHEET MATERIAL ASSEMBLAGES

BACKGROUND OF THE INVENTION

The present invention relates to an apparatus and method for forming sheet material assemblages such as newspapers, booklets, magazines, etc.

A known apparatus for forming sheet material assemblages includes a plurality of bottom opening pockets which move along a circular path under stationary hoppers and feeders. The feeders feed sheet material from the hoppers to the pockets. The pockets receive sheet material from each hopper to form sheet material assemblages. When the sheet material assemblage in a pocket is complete, the bottom of the pocket opens to drop the completed sheet material assemblage out of the pocket.

The stationary feeders include a rotatable drum with grippers. The grippers move sheet material from the hoppers. The grippers then release the sheet material to allow the sheet material to fall into a passing pocket. One example of an apparatus having this construction is described in U.S. Pat. No. 2,461,573 issued Feb. 15, 1949 and entitled "Machine for Stuffing Newspapers or Similar Sheet Material Assemblages".

SUMMARY OF THE PRESENT INVENTION

The present invention provides an improved apparatus and method in which sheet material assemblers move along a continuous path to sequentially pass beneath stationary stacks of sheet material disposed in bottomless hoppers. As the sheet material assemblers sequentially pass the stacks of sheet material, sheet material is fed from the stacks to receiving locations. Each sheet material assembler feeds sheet material from each stack of sheet material.

The sheet material assemblers include belts which support the stacks of sheet material. The belts have upper runs which are driven in a direction opposite to the direction of travel of the assemblers and at the same speed as the assemblers. Therefore, the upper belt runs are stationary relative to the stacks of sheet material. By having the upper runs of the belts stationary relative to the stacks of sheet material, there is no slippage between the belts and the sheet material.

The sheet material assemblers include feed mechanisms which move sheet material from the bottom of the stacks of sheet material. The feed mechanisms move sheet material along paths extending between adjacent belts to receiving locations. A sheet material assemblage is formed at each of the receiving locations.

When the article being assembled is a newspaper, a jacket is fed first to a receiving location which may be an open pocket. The pocket closes and vacuum is applied by a sucker to an edge of the jacket. The pocket and jacket are then opened and a brush presses the edge of the jacket against a support or locating member. A gripper then holds the edge of the jacket against the support member. Once the gripper has gripped the edge of the jacket, the vacuum is released.

The sheet material assemblers sequentially move past each of the stacks of sheet material and feed sheet material into the open jackets from each of the stacks in turn. After the sheet material assembler has fed sheet material from each stack, the bottom of the pocket opens and the completed newspaper drops out.

Although particularly advantageous for newspapers, the apparatus and method could be used for other types of sheet material assemblages, such as booklets, magazines, stacks of paper, etc. Although the receiving locations may be bottom opening pockets, the receiving locations could have a different construction.

BRIEF DESCRIPTION OF THE DRAWINGS

The foregoing and other objects and features of the present invention will become more apparent upon a consideration of the following description taken in connection with the accompanying drawings, wherein.

DESCRIPTION OF A SPECIFIC PREFERRED EMBODIMENT OF THE INVENTION

General Description

Figure 1:
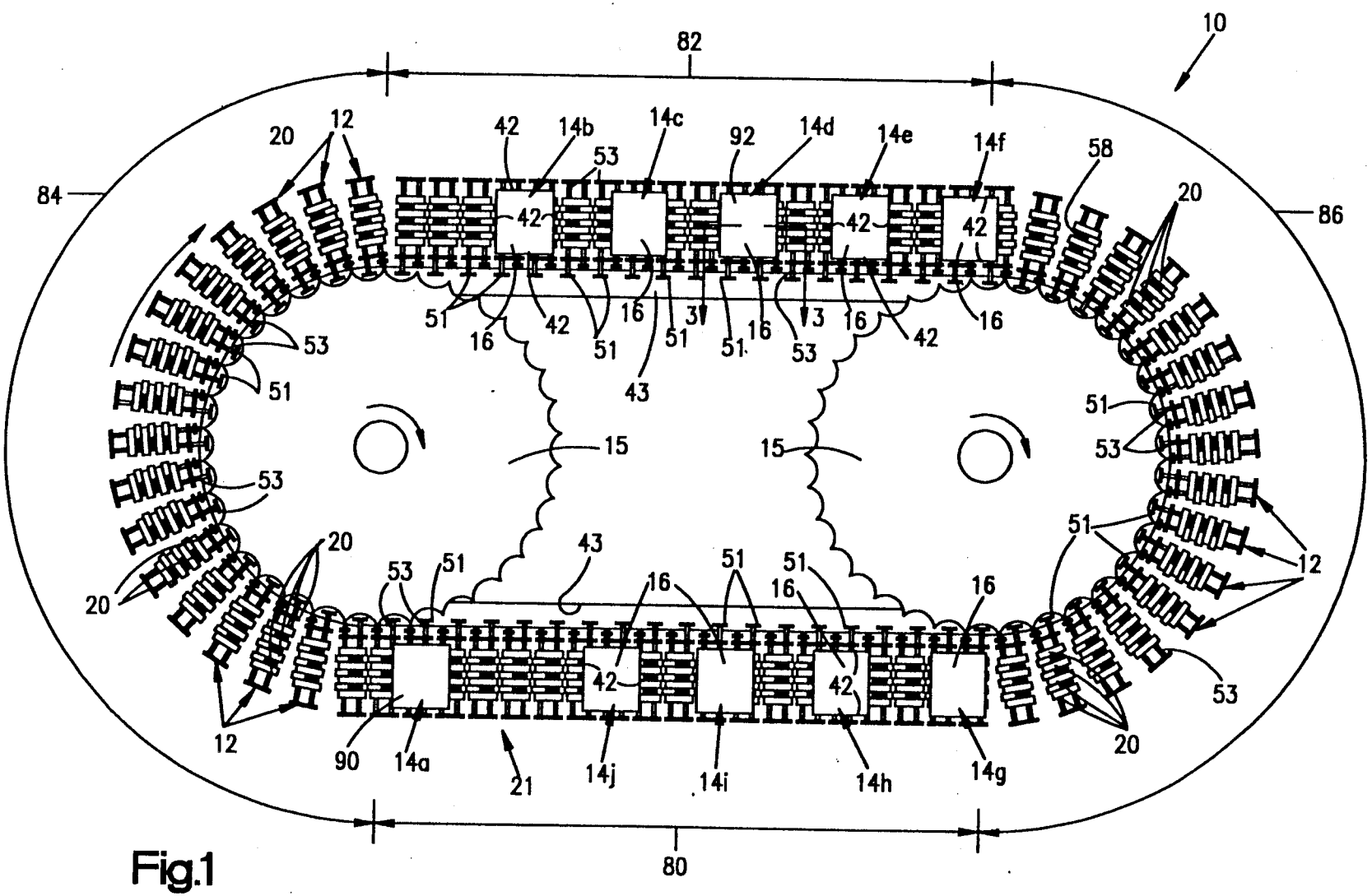
FIG. 1 is a schematic plan view of an apparatus for forming sheet material assemblages and illustrating the relationship between stationary bottomless hoppers for receiving stacks of sheet material and movable sheet material assemblers.

An apparatus 10 (FIG. 1) for forming sheet material assemblages includes a plurality of sheet material assemblers 12. The sheet material assemblers 12 are linked together and are moved along a continuous path under stationary bottomless hoppers or cribs 14 by a pair of drive wheels or sprockets 15 which are rotated at a constant speed. Stacks 16 of sheet material are disposed in the bottomless hoppers or cribs 14. As the sheet material assemblers 12 move beneath each of the stationary stacks 16 of sheet material in turn, the assemblers feed sheet material from the stacks of sheet material to form sheet material assemblages.

The sheet material assemblers 12 all have the same construction and include belts 20 (FIGS. 1 and 2) which support the stationary stacks 16 of sheet material disposed in the bottomless hoppers 14. Thus, the belts 20 in the assemblers 12 cooperate to form a flat, horizontal bed or layer 21 (FIG. 1) which extends beneath all of the bottomless hoppers 14. The stacks 16 of sheet material rest on the bed 21 of belts 20.

Interference between the lower ends of the stationary stacks 16 of sheet material and the moving assemblers 12 is prevented by eliminating relative movement between the stacks of sheet material and the surfaces of the continuously driven belts 20 upon which the stacks rest. This is accomplished by having the surfaces of the belts 20 which engage the lower ends of the stacks 16 of sheet material move, relative to the assemblers 12, in a direction which is opposite to the direction of movement of the assemblers and at a speed which is equal to the speed of movement of the assemblers. Therefore, the surfaces of the belts 20 upon which the stacks 16 of sheet material rest are stationary relative to the bottomless hoppers 14 and stacks 16 of sheet material even though the assemblers 12 are continuously moving relative to the stationary bottomless hoppers and stacks of sheet material.

Figure 2:
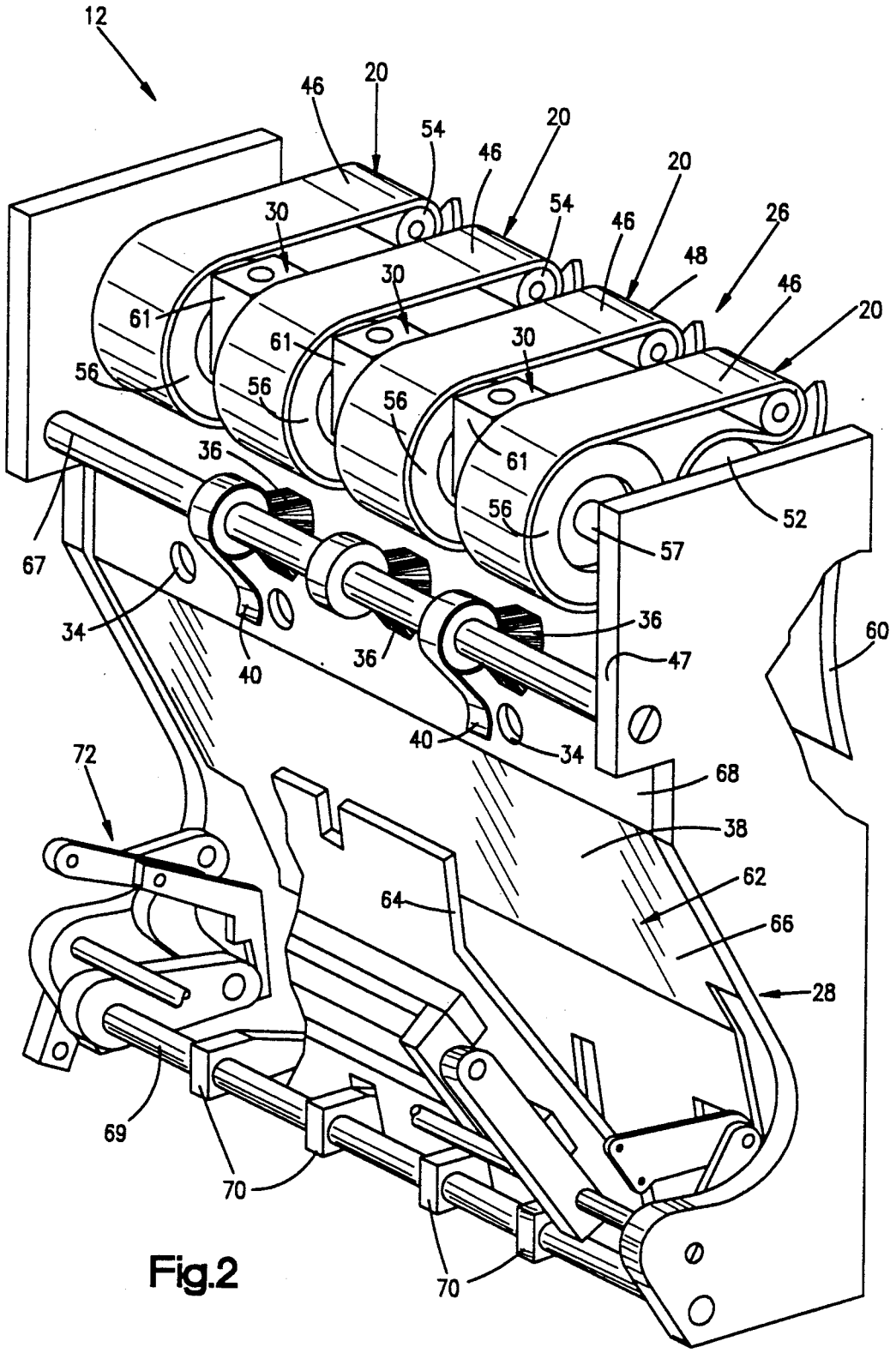
FIG. 2 is an enlarged and somewhat schematicized perspective view of one of the sheet material assemblers of FIG. 1, illustrating the relationship between belts which support the stacks of sheet material and a receiving location to which sheet material is fed.
Figure 3:
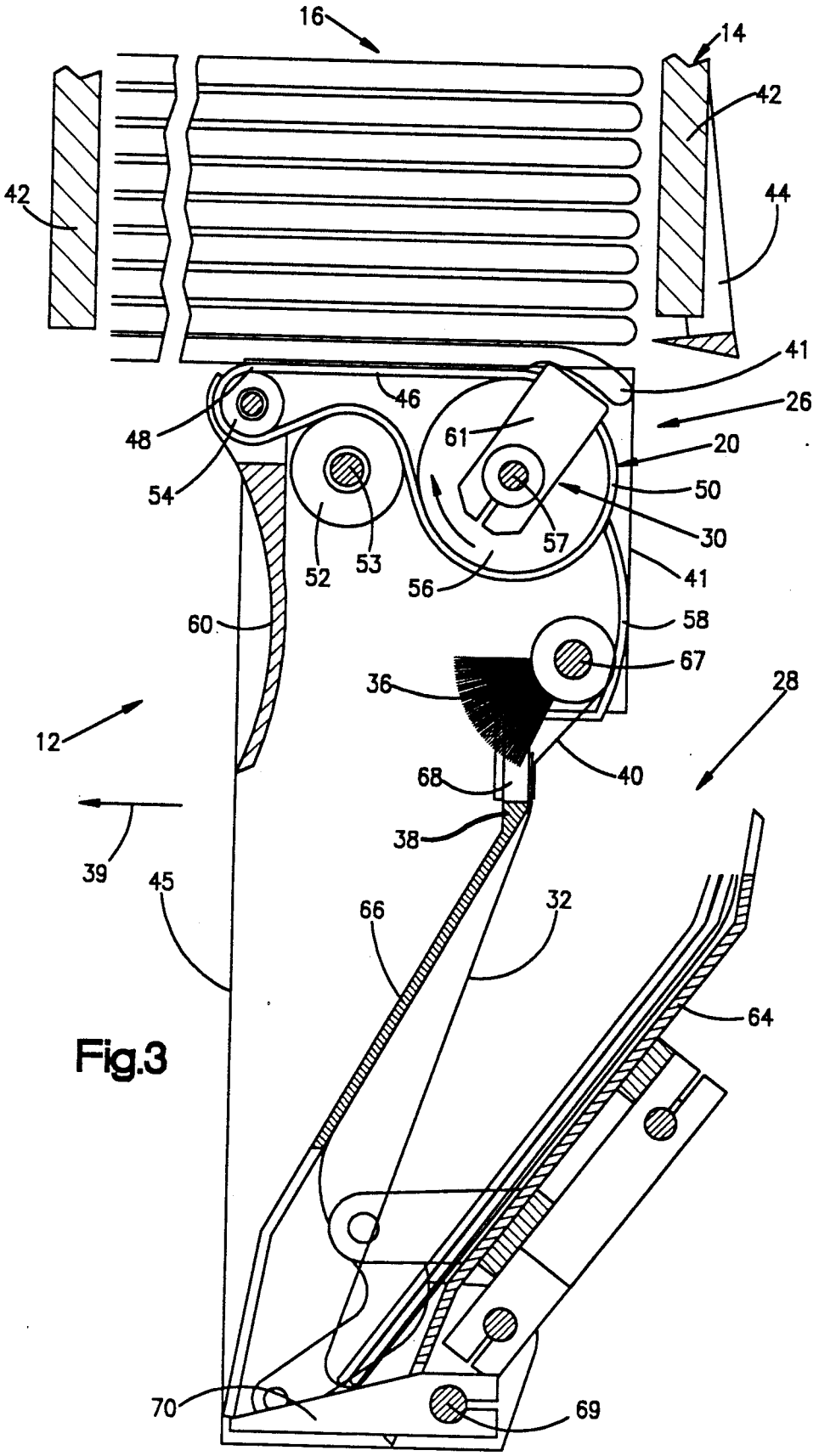
FIG. 3 is a sectional view of a sheet material assembler, taken along the line 3—3 of FIG. 1, illustrating the relationship between a stack of sheet material in a bottomless hopper and one of the sheet material assemblers.
Figure 4:
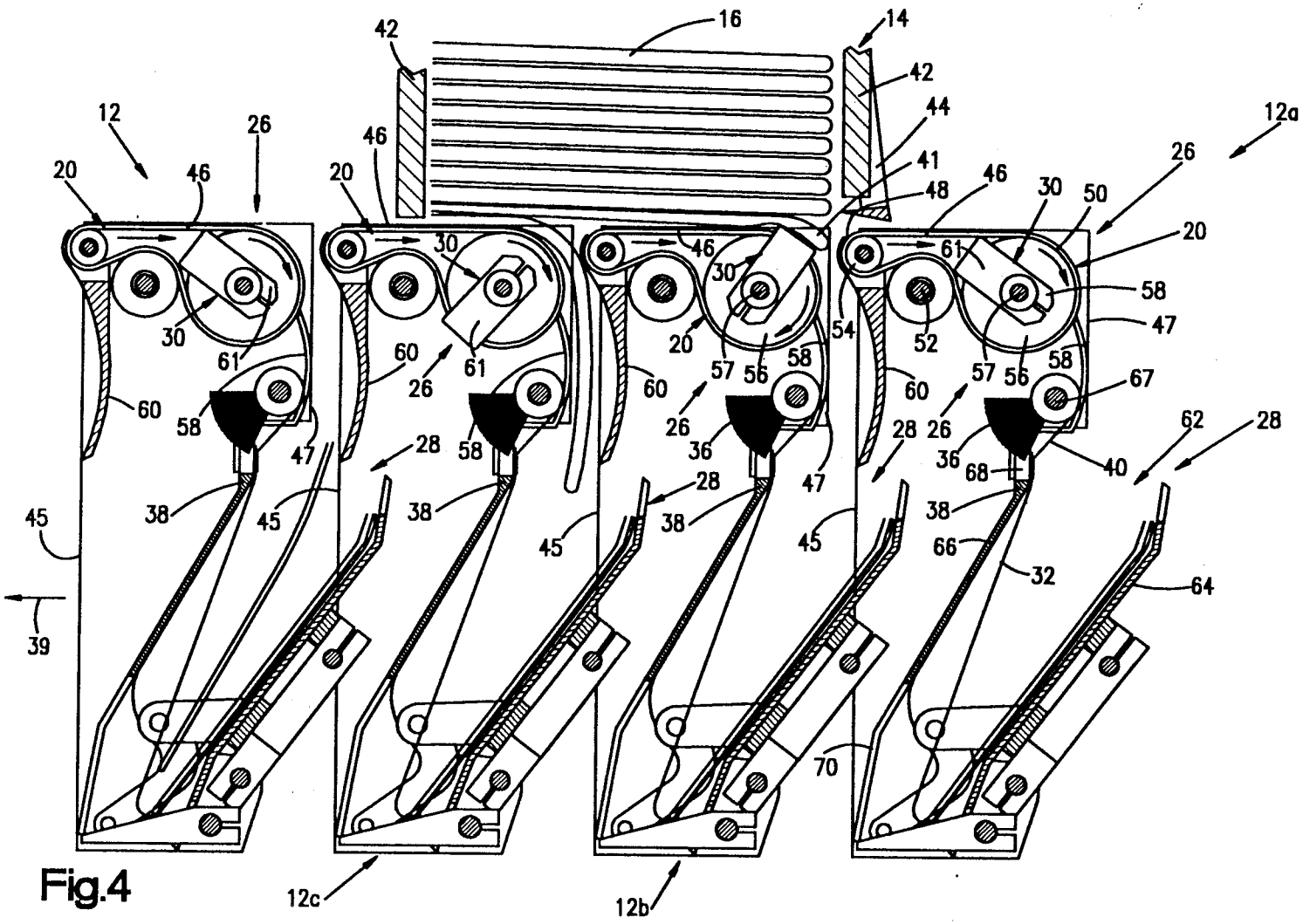
FIG. 4 is a sectional view illustrating the supporting of a stationary stack of sheet material on a plurality of movable assemblers, the gripping of sheet material to be fed from the stack by one of the assemblers, and the feeding of sheet material from the stack by another of the assemblers.

Each sheet material assembler 12 includes a feed mechanism 26 and a receiving location 28 (FIGS. 3 and 4). Each feed mechanism 26 includes vacuum grippers or suckers 30 (FIG. 2) which grip a lowermost sheet in a stack 16 of sheet material. The grippers 30 initiate downward movement of a gripped sheet of material along a path extending between the belts 20 to a pocket or receiving location 28. The feed mechanism 26 in each assembler 12 is operable to feed sheet material from each of the stacks 16 in turn to a single receiving location 28.

Figure 7:
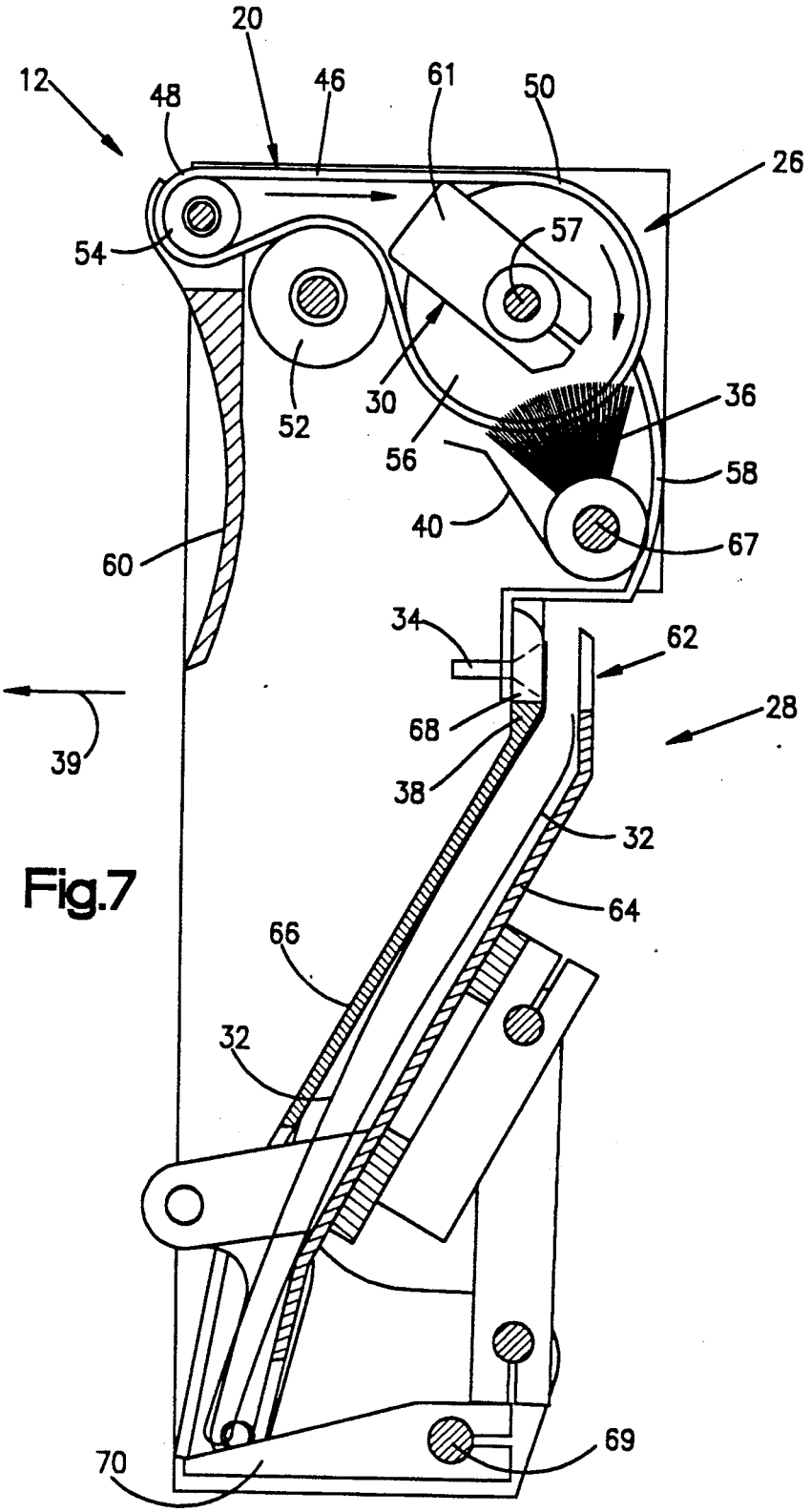
FIG. 7 is a sectional view one sheet material assembler with a sheet material receiving pocket in a closed condition.

When the sheet material in the bottomless hoppers 14 is to be used to form newspapers, a jacket or first sheet material section 32 is fed from a first bottomless hopper **14*a* (FIG. 1) to a pocket or receiving location 28 (FIG. 2). As the assemblers 12 move in a clockwise (as viewed in FIG. 1) direction along a continuous oval path, the receiving location or pocket 28 containing a jacket or cover section 32 closes (FIG. 7). A sucker 34 then applies vacuum to an edge portion of the closed jacket. The receiving location or pocket 28 then opens (FIG. 3**).

Brushes 36 are rotated to press the edge of the open jacket against a support or locating member 38. Grippes 40 then grip the edge portion of the jacket. The suckers 34 then release the gripped edge portion of the jacket. The jacket 32 is now held open by the grippers 40 to enable other sheet material items or inner sections to be inserted in the jacket.

After the open pocket 28 with the jacket 32 therein has moved around the arcuate end portion of the oval path of travel of the assemblers 12 to a position beneath the next bottomless hopper **14*b* (FIG. 1), an insert or inner section 41 (FIG. 3) is fed into the open jacket by the feed mechanism 26 as the assembler moves in the direction of the arrow 39 in FIGS. 3 and 4. As the assembler 12 moves along a linear path length extending beneath each of the bottomless hoppers 14*c*, 14*d*, 14*e* and 14*f* (FIG. 1) in turn, inserts 41 are fed into the open jacket 32 from each of the bottomless hoppers in turn by the feed mechanism 26. The assembler 12 then moves around an arcuate end portion of the oval path of travel of the assemblers to a linear path length extending beneath the bottomless hoppers 14*g*, 14*h*, 14*i* and 14*j*. As the assembler 12 moves beneath these hoppers, additional inner sections or inserts 41 are sequentially fed into the open jacket 32 from each of these bottomless hoppers by feed mechanism 26** to complete the newspaper.

At a location between the bottomless hoppers **14*j* and 14*a* (FIG. 1), the completed newspaper is removed from the pocket or receiving location 28. This is accomplished by opening the bottom of the pocket 28** and allowing the completed newspaper to drop onto a receiving conveyor (not shown) in a manner similar to that disclosed in U.S. Pat. No. 2,461,573, issued Feb. 15, 1949 and entitled "Machine for Stuffing Newspapers or Similar Sheet Material Assemblages".

The foregoing description has assumed that the sheet material assemblages formed by the apparatus 20 are newspapers. However, the apparatus 20 can be used to form sheet material assemblages other than newspapers. For example, the apparatus 20 could be used to sequentially feed single sheets of material from each of the bottomless hoppers 14.

Although each sheet material assembler 12 is used to feed sheet material from each of the stationary bottomless hoppers 14, sheet material could be fed from only some of the hoppers to a receiving location. Thus, sheet material could be fed from only bottomless hoppers **14*a*, 14*c*, 14*e*, 14*g* and 14*i* to a receiving location 28 in one assembler 12. Sheet material could be fed from only bottomless hoppers 14*b*, 14*d*, 14*f*, 14*h* and 14*j* to a receiving location 28 in an adjacent assembler 12. Of course, one or more of the bottomless hoppers 14** could be left empty and sheet material fed from only the remaining hoppers.

While it is preferred to use bottom opening pockets 28 as sheet material receiving locations, other known sheet material receiving devices could be used if desired. For example, the receiving locations 28 could be flat supports with pushers for engaging trailing edges of the sheet material assemblages and moving them relative to the stationary stocks 16 of the sheet material. In the illustrated embodiment of the invention each feed mechanism 26 feeds sheet material to only one receiving location 28. However, if desired, the assemblers 12 could be constructed so that each feed mechanism could be operated to feed sheet material to a plurality of receiving locations.

In the illustrated embodiment of the invention the drive sprockets 15 continuously move the chain of interconnected sheet material assemblers 12 along a generally oval path. However, it is contemplated that the assemblers 12 could be moved along a path having a different configuration, for example polygonal. Since the spacing between adjacent assemblers 12 is uniform along the linear path lengths and increases radially outwardly from the drive sprockets 15 along the arcuate path lengths, it is preferred to locate the bottomless hoppers 14 along the linear path lengths. However, bottomless hoppers 14 could be located along arcuate path lengths if desired.

Bottomless Hopper

Each of the rectangular bottomless hoppers or cribs 14 has four vertical walls 42 (FIGS. 1 and 3). The stationary vertical walls 42 form an open ended tube having a rectangular cross sectional configuration. The four vertical walls 42 engage sides of a stack 16 of sheet material to prevent the stack 16 from moving relative to a stationary base 43 (FIG. 1) of the apparatus 10.

The bottomless hoppers 14 also have fingers 44 (FIG. 3) to separate layers of sheet material as it is being fed. The fingers 44 also partially support one edge portion of the sheet material remaining in a bottomless hopper 14 as a lower layer is fed from the hopper. The lower ends of the hoppers 14 have unobstructed rectangular openings of a size equal to or slightly greater than the bottom of a stack 16 of sheet material. This enables sheet material to be readily fed from the open lower ends of the bottomless hoppers 14.

Assembler Mechanism—Belts

The belts 20 (FIGS. 1 and 2) in the identical assemblers 12 support the stacks 16 of sheet material. Thus, the belts 20 on adjacent assemblers 12 form an endless oval layer or array 21 (FIG. 1) having a horizontal upper surface upon which the stacks 16 of sheet material rest. Of course, the configuration of the layer 21 of belts 20 corresponds to the configuration of the path along which the sheet material assemblers 12 move.

Figure 5:
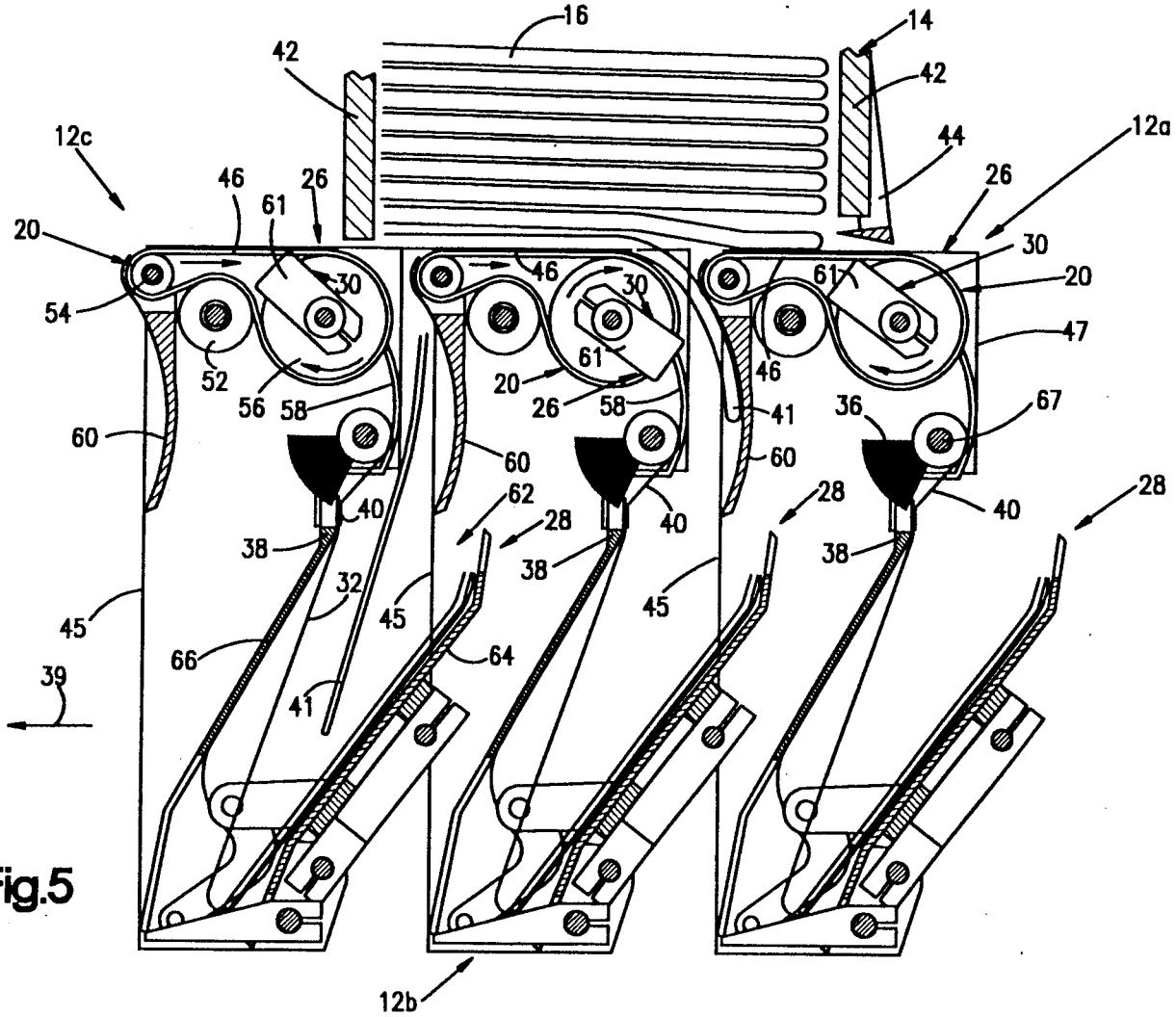
FIG. 5 is a sectional view of the sheet material assemblers of FIG. 4 after they have moved forward relative to the stack of sheet material.

Each stack 16 of sheet material is supported by belts 20 in a plurality of sheet material assemblers 12 (FIGS. 4 and 5). This is because the distance between a leading end 45 and trailing end 47 of a sheet material assembler 12 is less than the extent of a bottomless hopper 14 in the direction of travel of the assemblers. The belts 20 in each assembler 12 are spaced apart in a sideward direction (FIG. 2). Even though there is spacing between the belts 20, the belts 20 engage a major portion of the bottom of each stack 16 of sheet material to provide support for the stacks. It should be understood that the entire weight of the stacks 16 of sheet material is carried by the horizontal upper surface of the layer 21 of belts 20.

The vertical walls 42 of the bottomless hoppers 14 extend perpendicular to and are disposed above the oval layer or array 21 of belts 20. Although the lower ends of the stationary hopper walls 42 are close to the belts 20, they may be spaced from the belts by a distance which is greater than the thickness of a layer of sheet material. Friction between adjacent layers of sheet material and the stationary relationship between the upper surfaces of the belts 20 and the bottoms of the stacks 16 result in the feed mechanisms 26 feeding a single layer of sheet material at a time to a pocket or receiving location 28.

Horizontal upper runs 46 of the belts 20 and the assemblers 12 move in opposite directions. The speed at which the assemblers 12 move relative to the base 43 is the same as the speed at which the upper runs 46 of the belts move relative to the assemblers. This results in the upper runs 46 of the belts being stationary relative to the stacks 16 of sheet material and frame 43.

Thus, the assemblers 12 are moving toward the left (as viewed in FIGS. 4 and 5) relative to the stationary bottomless hopper 14 and stack 16 of sheet material. The upper runs 46 of the belts 20 are moving toward the right (as viewed in FIGS. 4 and 5) relative to the assemblers 12. The speed of movement of the assemblers 12 toward the left (as viewed in FIGS. 4 and 5) relative to the stack 16 is equal to the speed of movement of the upper runs 46 of the belts 20 toward the right relative to the assemblers. Therefore, the upper runs 46 of the belts 20 are stationary relative to the stack 16 of sheet material.

The bottoms of the stacks 16 of sheet material are supported on the upper runs 46 of the belts 20 (FIG. 3). Since the horizontal upper runs 46 of the belts 20 are not moving relative to the stationary stacks 16 of sheet material, there is no interference between the upper runs of the belts and the bottoms of the stacks of sheet material. In addition, the leftward (as viewed in FIGS. 4 and 5) movement of the assemblers 12 relative to the stacks 16 of sheet material does not tend to dislodge the lowermost sheets or layers from the stacks of sheet material. Since there is little or no tendency for the stacks of sheet material to move along with the assemblers 12, there is little or no friction between the stacks 16 of sheet material and the bottomless hoppers 14. Therefore, the sheet material can be readily fed from the hoppers by the feed mechanisms 26 in the assemblers 12.

As the assemblers 12 move past each of the stacks 16 of sheet material in turn, the upper runs 46 of the belts 20 are displaced or rolled along the bottom surface of the stack of sheet material. Thus, as a portion 48 of a belt 20 moves into engagement with the lower surface of a stack 16 of sheet material, a surface area on the upper run 46 of the belt 20 engages the lower surface of a stack of sheet material (FIG. 5). The surface area on the upper run 46 of the belt which initially engages the bottom of the stack 16 of sheet material does not slide along the bottom surface of the stack as the assembler 12 moves toward the left as viewed in FIG. 3.

The portion 48 of the upper run of the belt 20 which initially engages the bottom of a stack 16 of sheet material remains stationary on the bottom of the stack 16 as the assembler 12 moves toward the left (as viewed in FIG. 3). This results in the assembler 12 moving leftwardly beneath the stationary portion of the upper run of the belt which initially engaged the stack 16 of sheet material. Therefore, the assembler 12 moves from a position in which the portion 48 of the upper run 46 which initially engages the stack of sheet material is leading to a position in which the portion 48 of the upper run of the belt which initially engaged the bottom of the stack of sheet material is trailing (FIGS. 4 and 5).

As an assembler 12 moves beneath a stack 16 of sheet material, the upper run 46 of a belt 20 is rolled into engagement with the bottom of the stack 16 of sheet material. As the assembler 12 continues to move relative to the stack 16, the upper run 46 of the belt 20 moves across the bottom of the stack and out of engagement with the stack. As this occurs, the upper run 46 of the belt 20 does not slide along the bottom of the stack of sheet material. This results in the belt 20 being moved across the bottom of the stack 16 of sheet material with a rolling action.

The belts 20 are constantly driven at the same speed as the assemblers 12 by drive rollers 51 (FIG. 1) which continuously roll along the stationary frame 43 of the apparatus 10. The drive rollers 51 are connected with belt drive rollers 52 (FIG. 3) by a drive shaft 53. The drive roller 51 which engages the stationary frame 43 has the same diameter as the roller 52 which engages the belt 20. Therefore, the roller 52 continuously drives a belt 20 at the same speed as which the assembler 12 moves relative to the frame.

Each of the belts 20 extends around a pair of idler rollers 54 and 56 (FIG. 3) which support the belt for movement under the influence of the drive roller 52. Although it is preferred to drive the belt 20 by having a drive roller 51 driven by engagement with the stationary frame 43, the belts could be driven by electric motors or other devices if desired. Although there are four belts 20 for each sheet material assembler 12 in the illustrated embodiment of the invention, there could be one or more belts if desired.

Assembler Feed Mechanism

The feed mechanisms 26 are operable to feed a lower layer or sheet from each of the stacks 16 in turn through the layer or bed of belts 20 to a pocket or receiving location 28. When the trailing end portion 47 of an assembler 12 first moves beneath a stack 16 of sheet material (FIG. 3), a suction gripper 30 engages a downstream or right end portion (as viewed in FIG. 3) of a lowermost layer or sheet on the stack. At this time, a shaft 57 rotates the gripper 30 in a clockwise direction, as viewed in FIG. 3, to pull the end portion of the lowermost layer or sheet downwardly into the path of movement of the belts 20. This partially separates the lowermost layer or sheet from the remaining layers or sheets in the stack 16.

The speed of movement of the gripper 30 is the same as the speed of movement of the associated belts 20. The gripper 30 and the trailing portions of the associated belts 20 are rotated at the same speed about the central axis of the shaft 57 (FIG. 3). Therefore, there is no slippage of the lower layer of sheet material relative to the belts 20 as the sheet material is pulled downwardly by the gripper 30. The gripper 30 merely causes the downstream end portion of the lowermost sheet or layer to be deflected away from the remainder of the stack 16 and to lay in flat abutting engagement with the arcuate trailing portion of the belt extending around the idler roller 56.

As the gripper 30 continues to rotate with the shaft 57 and belt idler roller 56, the downstream end portion of the lowermost sheet or layer on the stack 16 is pulled downwardly between belts 20 on adjacent sheet material assemblers 12. Thus, the gripper 30 moves the downstream end portion of the lowermost layer 41 between belts 20 on a trailing assembler **12*a* (FIG. 4) and a leading assembler 12*b*. As the assemblers 12*a* and 12*b* move forwardly relative to the stationary stack 16 and bottomless hopper 14, the sheet material layer 41 continues to move downwardly through a space or gap between the belts 20 of the assemblers 12*a* and 12*b* toward the pocket or receiving location 28 in the assembler 12*b* (FIGS. 4 and 5**).

As the gripper 30 continues to rotate with the belt 20 of the assembler **12*b*, the downstream end portion of the layer 41 moves into engagement with a stripper plate 58. As this occurs, the vaccum to the gripper 30 is interrupted and the gripper releases the layer 41. The gripper 30 continues to rotate until it reaches the initial position shown in FIG. 3. Rotation of the gripper is then interrupted until a layer in a next succeeding stack 16** is to be fed.

Figure 6:
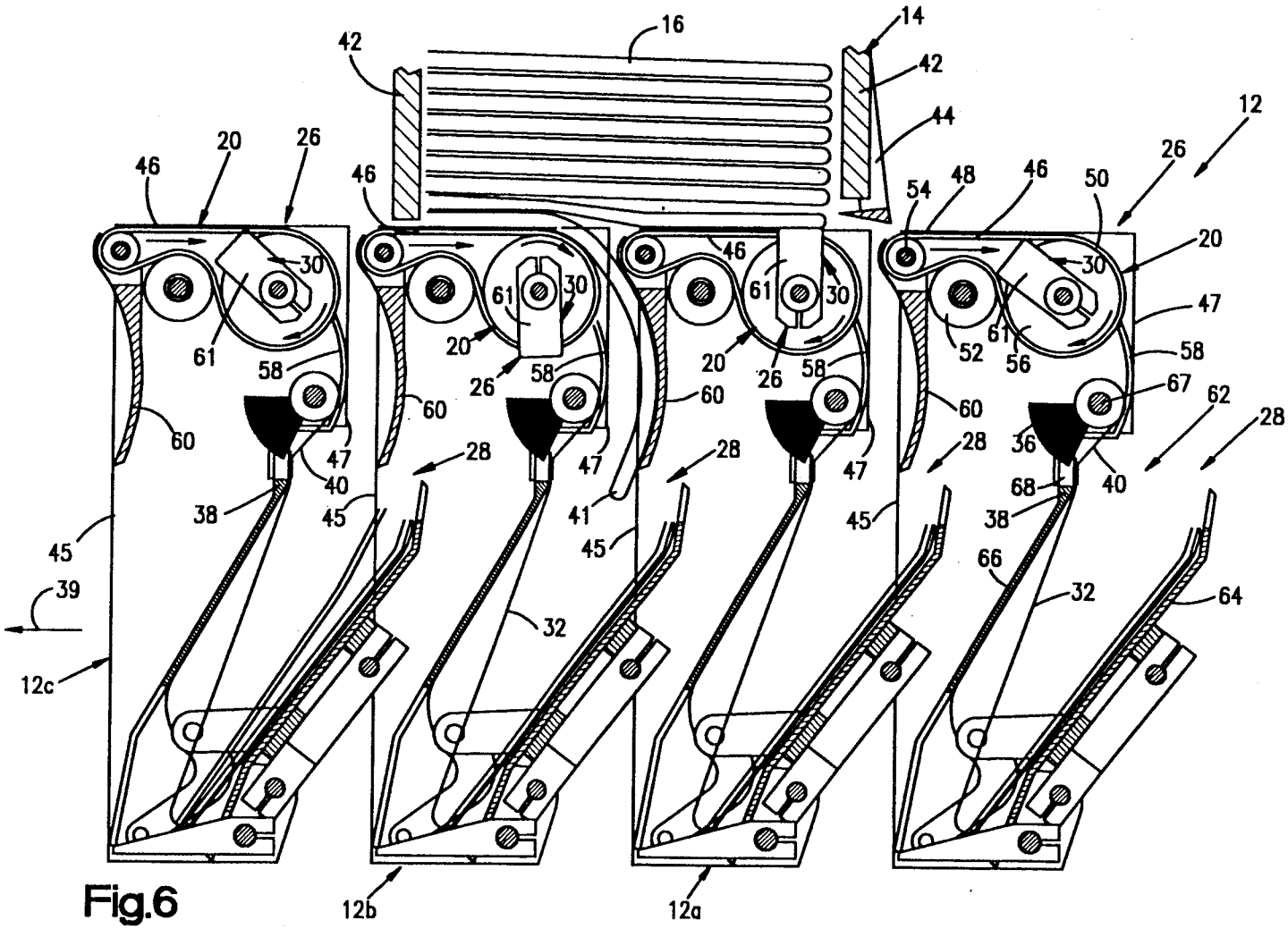
FIG. 6 is a sectional view of the sheet material assemblers of FIG. 5 after they have moved further forward relative to the stack of sheet material.

When the gripper 30 releases the layer 41, the natural resilience of layer 41 tends to cause it to spring back against a guide plate 60 in the trailing assembler **12*a*. Continued leftward movement of the assemblers 12*a* and 12*b* from the position shown in FIG. 5 to the position shown in FIG. 6 results in the layer 41 of sheet material being deflected toward the receiving location or pocket 28 of the leading assembler 12*b* by the guide member 60 on the trailing assembler 12*a*. It should be noted that the guide member 60 in each assembler is aligned with an open receiving location 28 in a next succeeding assembler 12 (FIGS. 4–6**).

The layer 41 of sheet material is separated from the bottom of the stack 16 with a stripping action as the assemblers **12*a* and 12*b* move across the bottom of the stack 16. This stripping action results from the movement of the assemblers 12*a* and 12*b* and, at this time, is independent of the gripper 30. Since the belts 20 in the assembler 12*b* are driven at the same speed as the assembler, there is no sliding between surfaces of the belt and the sheet material 41 as it is fed downwardly into the pocket 28. However, the sheet material does slide along the surface of the guide member 60 of the trailing assembler 12*a* (FIG. 6**).

Continued leftward (as viewed in FIG. 6) movement of the assemblers **12*a* and 12*b* strips the sheet material layer or insert 41 from the bottom of the stack 16 and releases it for movement into the pocket 28 of the assembler 12*b*. This occurs the same manner as in which a sheet material layer or insert 41 is moving into the pocket 28 of the assembler 12*c* in FIG. 5. When the sheet material layer 41 falls into the pocket 28 of the assembler 12*b*, it is disposed in a side-by-side relationship with other inserts located in the open jacket 32**.

The grippers 30 are of the suction type and have a suction head 61 which is intermittently rotated by the shaft 57. Suction or vacuum is supplied to the gripper 30 only when a sheet material layer 41 is to be engaged by the gripper. Although a suction or vacuum type gripper 30 is preferred, a mechanical gripper could be used if desired.

Assembler—Receiving Location

Receiving locations or pockets 28 have side walls 64 and 66 which are pivotal toward each other to press an end portion of a jacket 32 against a vacuum head or suckers 34 (FIG. 7). Once the suckers 34 have securely gripped the upper end portion of the jacket 32, the pocket 28 is returned to the open condition of FIG. 3. As the pocket 28 opens, the right side (as viewed in FIGS. 3 and 7) of the jacket 32 is free to pivot in a clockwise direction as the side wall 64 of the pocket 28 moves away from the opposite side wall 66. The left side of the jacket 32 is held against the side wall 66 by the suction head 34.

Once the pocket 66 has been opened, a shaft 67 is rotated so that flexible bristles of a brush 36 press the upper end portion of the open jacket 32 against a support or locating member 68 connected with the side wall 66. As the brush and bristles are rotated, a clamp member 40 moves into abutting engagement with the upper end portion of the jacket 32 to hold the jacket against the locating member 68 in the manner illustrated in FIG. 3. After the grippers 40 have engaged the upper end portion of the open jacket 32, the suction or vacuum to the head 34 is turned off and the jacket is held open by the gripper 40.

Operation of the pocket 28 from the open condition of FIG. 3 to the closed condition of FIG. 7 and back to the open condition of FIG. 5 occurs during movement of an assembler 12 along the arcuate path length extending from the bottomless hopper **14*a* to a location immediately adjacent to the bottomless hopper 14*b* (FIG. 1). The relatively long distance in which an assembler travels from the bottomless hopper 14*a* to the bottomless hopper 14*b* provides more than enough time for a pocket to be moved from the open condition of FIG. 3 to the closed condition of FIG. 7 and back to the open condition of FIG. 3**.

After a newspaper has been assembled in a pocket 28, the shaft 67 is rotated in a counterclockwise direction from the position shown in FIG. 3 to the position shown in FIG. 7 to move the grippers 40 out of engagement with the jacket 32. This releases the jacket so that the completed newspaper is free in the closed pocket or receiving location 28.

As the pocket 28 moves to a drop off station disposed between the bottomless hoppers **14*j* and 14*a*, the assembler 12 is actuated to open the bottom of the pocket. To open the bottom of the pocket 28, a support bar 69 (FIG. 3) is rotated in a counterclockwise direction to pivot a plurality of support bars or fingers 70 downwardly (as viewed in FIGS. 2 and 3). This allows the completed newspaper to drop out of the pocket 28**.

To open the pocket 28, a linkage 72 (FIG. 2) is actuated by a stationary cam disposed on the base 43 (FIG. 1) between the bottomless hopper 14*j* and the bottomless hopper 14*a*. Upon actuation of the linkage 72 by the cam, the shaft 69 is rotated to rotate the fingers 70 and open the pocket. After the completed newspaper has dropped out of the pocket, the linkage 72 is again actuated by the cam to close the bottom of the pocket so that the pocket is ready to receive a jacket section from the bottomless hopper 14*a*. A suitable conveyer (not shown) is provided to transport the completed newspapers away from the drop off location. The manner in which the bottom of the pockets 28 are opened to drop a completed newspaper is similar to that disclosed in the aforementioned U.S. Pat. No. 2,461,573.

Gripper Actuation

Figure 8:
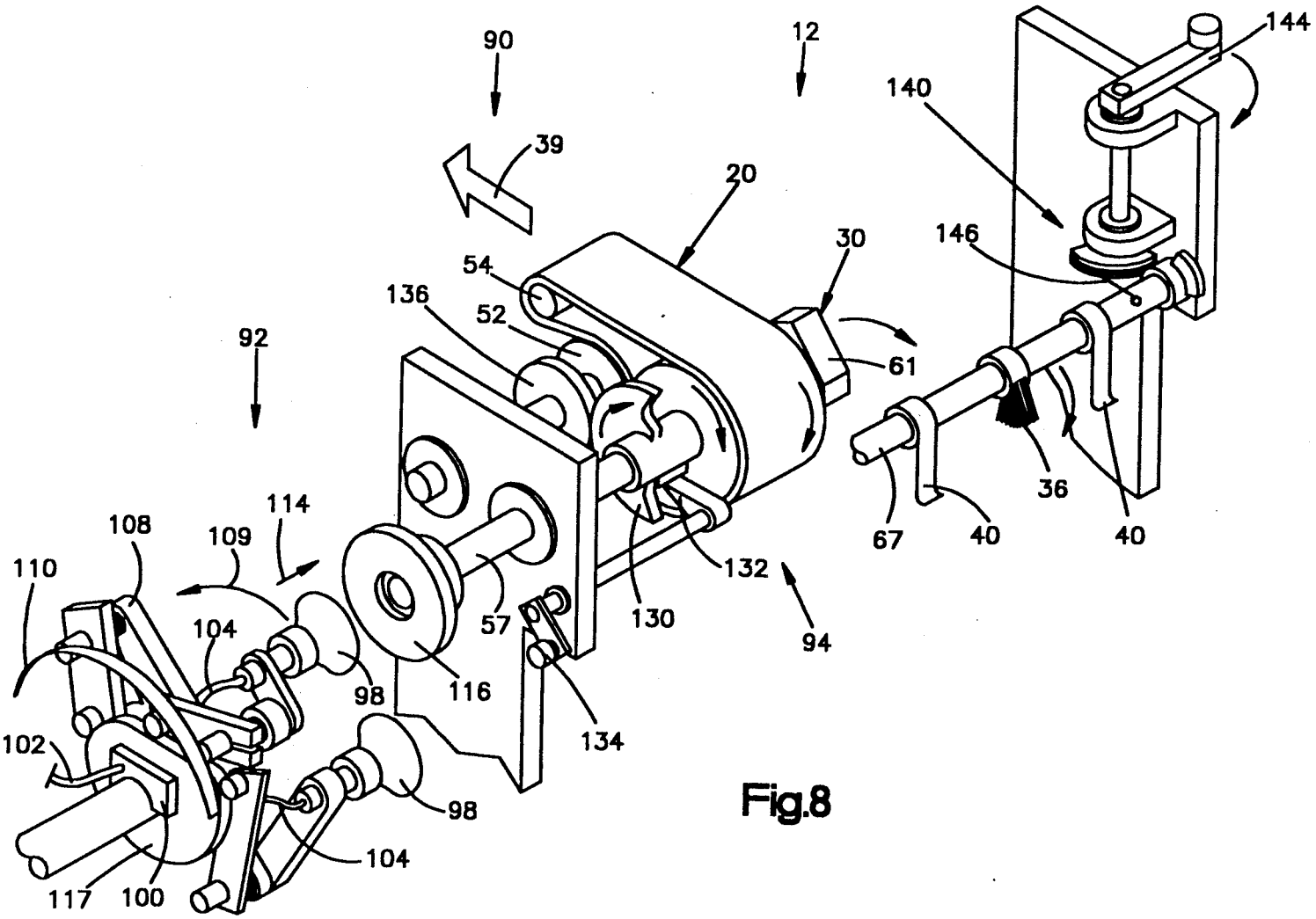
FIG. 8 is a schematic illustration of an apparatus for controlling the operation of grippers in each of the sheet material assemblers in turn.

The grippers 30 in an assembler 12 may be actuated by many different types of mechanisms. One specific gripper actuation mechanism 90 is illustrated in FIG. 8. A vacuum control assembly 92 controls the supply of vacuum or suction to a gripper actuator mechanism 90 in an assembly 12. A gripper drive assembly 94 is operable to effect rotation of the gripper 30.

The suction control assembly 92 includes vacuum connections or suction cups 98 which are intermittently supplied with vacuum by a vacuum timing device 100. The vacuum timing device 100 is connected with a source of suction or vacuum through a conduit 102. The vacuum timing device 100 is connected with the vacuum connections or suction cups 98 through a conduit 104. The vacuum timing device 100 is controlled by and the suction cups 98 are driven by a drive lever 108 (FIG. 8). As an assembler 12 moves past the vacuum control assembly 92, in the direction of the arrow 39 in FIG. 8, the lever 108 is rotated, in the direction of the arrow 109, by power transmitted from the main drive. Rotation of the lever 108 actuates the vacuum timing device 100 to cause suction or vacuum to be ported to the vacuum cup 98. This suction or vacuum is conducted through the hollow shaft 57 to the gripper 30.

As the drive lever 108 is rotated, in a counterclockwise direction as viewed in FIG. 8, a horizontal motion cam 110 moves a cam follower 112 toward the right (as viewed in FIG. 8). This moves the suction cup 98 in the direction indicated by the arrow 114 to engage a sucker shaft vacuum pad 116 of an assembler. Once the suction cup 98 has engaged the sucker shaft vacuum pad 116, vacuum is conducted from the vacuum timing device through the shaft to the gripper 30. A cam 117 modifies the circular path of movement of the suction cups 98 to match the straight line motion of the sucker shaft vacuum pad 116.

Since the assembler 12 is moving in the direction of the arrow 39 in FIG. 8, the vacuum connection or suction cup 98 must also be moved with the assembler 12. A drive assembly for the levers 108 and suction cups 98 includes a spider driven off the line shaft to synchronously match the vacuum cups 98 to the vacuum pad 116. The drive assembly may include a star wheel drive or may be constructed in a manner similar to the vacuum system drive of U.S. Pat. No. 4,723,770.

Each time a layer 41 of sheet material is fed from a stack 16, the gripper head 61 must be rotated through one complete revolution. This is accomplished by having the gripper head 61 connected with a continuously rotating gear 130 through a single revolution clutch 132. The single revolution clutch 132 is actuated by engagement of an arm 134 with a cam mounted on the base 43. The gear 130 is continuously driven by a drive gear 136 at a rotational speed which is the same as the rotational speed of the drive roller 52 for the belt 20.

A gripper finger and brush drive assembly 140 is operable to rotate the shaft 67 to rotate the gripper fingers 40 and brushes 36. The gripper finger and brush drive assembly 140 includes an actuator arm 144 which is rotated by a stationary projection on the base 43. Rotation of the arm 144 is transmitted through a flexible cable 146 to the shaft 67 to effect rotation of the shaft.

Operation

The sheet material assemblers 12 travel along a continuous path (FIG. 1) sequentially passing each stack 16 of sheet material. The path has a first linear section 80 and a second linear section 82. The linear sections 80 and 82 are interconnected by a first nonlinear section 84 and a second nonlinear section 86. The sheet material assemblers 12 are interconnected in a continuous chain by links on the inside of the path along which the assemblers move.

The spacing between adjacent assemblers 12 remains constant and uniform in the linear sections 80 and 82. As the assemblers 12 move from a linear section 80 or 82 to a nonlinear section 84 or 86, the space between the assemblers increases at the outer end portions of the assemblers which are furthest from the centers of the drive wheels or sprockets 15. Similarly, as the assemblers 12 move from a nonlinear section 84 or 86 to a linear section 80 or 82, the space between the assemblers decreases at the outer end portions of the assemblers.

Since the speed of rotation of the sprockets 15 is constant, the speed of movement of the inner end portions of the assemblers 12 remains constant. However, the speed of the outer end portions of the assemblers 12 increases as they move from a linear section 80 or 82 to a nonlinear section 84 or 86. Similarly, the speed of the outer end portions of the assemblers 12 decreases as they move from a nonlinear section 84 or 86 to a linear section 80 or 82.

At the end of the linear section 80, the bottomless hopper 14*a* has disposed in it a stack 16 of jacket sections 32. When a sheet material assembler 12 passes beneath the stack 16 of jacket sections 32, a jacket section is fed to a receiving location 28 by a feeder mechanism 26. While a sheet material assembler 12 travels around the nonlinear section 84, the jacket section 32 in the assembler is opened so that it can receive sheet material to be inserted into the jacket section. The opening of the jacket section may be done at any time after a jacket 32 is fed and before the time of the feeding of the first sheet material insert at the bottomless hoper 14*b*.

When a jacket section 32 is to be opened, the pocket 28 closes (FIG. 7) and suckers 34 grip the edge of the jacket. The top of the receiving location or pocket 28 is then opened (FIG. 3) and brushes 26 press the edge of the jacket 32 against a support or locating member 66. Grippers 40 then grip the edge of the jacket 32.

The sheet material assembler 12 (FIG. 1) then moves under a first linear array of stacks 16 of sheet material disposed above the linear section 82 of the continuous path. Sheet material is fed from each of the stationary stacks 16 in the first linear array into the open jacket section 32.

As a sheet material assembler 12 moves beneath a stationary stack 16 of sheet material (FIGS. 3–6), grippers 30 engage edge portions of a lowermost layer of sheet material 41 in the stack 16 of sheet material. The grippers pull the engaged edge portion downwardly into the path of the belts 20. When the edge portion of the sheet material has been pulled sufficiently downward into the path of the belts 20, the grippers 30 release the sheet material and the sheet material is guided by the guide member 60 on the next succeeding assembler. As the assembler 12 continues to move beneath a stack 16 of sheet material, the sheet material moves further downward between adjacent belts and into a jacket 32 in an open pocket 28.

The sheet material assembler 12 then moves along the arcuate end sections 86 to the second linear section 80. The assembler then moves under a second linear array of stacks 16 of sheet material. Sheet material is fed from each stack 16 of sheet material in the linear array in turn. After the assembler 12 has moved past the stacks 16 in the bottomless hoppers **14*g*, 14*h*, 14*i* and 14*j*, a completed sheet material assemblage is located in the pocket 28. The sheet material assembler 12 then passes through a delivery or drop off area in which the completed sheet material assemblage is removed from the pocket 28. After the sheet material assembler 12 moves through the delivery area, a jacket 32 is fed into the receiving location 28 from the bottomless hopper 14*a*** and the cycle is repeated.

Although the preferred embodiment of the present invention discloses sheet material assemblers 12 each of which has a feed mechanism 26 which feeds sheet material from each of the stacks of sheet material to a receiving location 28, the invention could be constructed in many other ways. For example, each of the feed mechanisms could feed from a single stack 16 of sheet material to a plurality of receiving locations. Although the preferred embodiment of the present invention discloses the use of an oval continuous path, the path could be of any desired shape.

Conclusion

The present invention provides an apparatus 10 in which sheet material assemblers 12 travel in a continuous path to sequentially move beneath stacks 16 of sheet material in bottomless hoppers 14. As the sheet material assemblers 12 sequentially pass the stacks 16 of sheet material, sheet material is fed from the stacks to receiving locations 28. Each sheet material assembler 12 feeds sheet material from each stack 16 of sheet material.

The sheet material assemblers 12 include belts 20 which support the stacks 16 of sheet material. The belts 20 have upper runs 46 which are driven in an opposite direction to the direction of travel of the assemblers 12 and at the same speed as the assemblers. Therefore, the upper belt runs 46 are stationary relative to the stacks 16. By having the upper runs 46 of the belts 20 stationary relative to the stacks 16 of sheet material, there is no slippage between the belts and the sheet material.

The sheet material assemblers 12 include feed mechanisms 26 which move sheet material from the bottom of the stacks of sheet material. The feed mechanism 26 move the sheet material along paths extending between belts 20 on adjacent assemblers 12 to receiving locations 28. A sheet material assemblage is formed at each of the receiving locations 28.

When the article being assembled is a newspaper, a jacket 32 is fed first to a receiving location 28 which is an open pocket 28 (FIG. 3). The pocket 28 closes and vacuum is applied by a sucker 34 to an edge of the jacket 32 (FIG. 7). The pocket 28 and jacket 32 are then opened and a brush 36 presses the edge of the jacket against a support or locating member 68. A gripper 40 then holds the edge of the jacket 32 against the support member 68 (FIG. 3). Once the gripper 40 has gripped the edge of the jacket 32, the vacuum is released.

The sheet material assemblers 12 sequentially move past each of the stacks 16 of sheet material and feed sheet material into the open jackets 32 from each of the stacks 16 in turn. After the sheet material assembler 12 has fed sheet material from each stack 16, the bottom of the pocket 28 opens and the completed newspaper drops out.

Although particularly advantageous for newspapers, the apparatus 10 could be used for other types of sheet material assemblages, such as booklets, magazines, stacks of paper, etc. Although the receiving locations may be bottom opening pockets 28, the receiving locations could have a different construction. For example, the receiving locations could be flat supports with pushers for engaging trailing edges of the sheet material assemblage and moving them relative to the stacks 16 of sheet material.

Having described a specific preferred embodiment of the invention, the following is claimed:

1. An apparatus for forming sheet material assemblages, said apparatus comprising means for holding a plurality of stacks of sheet material, a plurality of receiving locations, means for sequentially moving each of said receiving locations past each of the stacks of sheet material in turn, a plurality of feeder means for feeding sheet material from the stacks of sheet material to the receiving locations, each of said feeder means being operable to feed sheet material from each stack of the plurality of stacks of sheet material, and means for sequentially moving said plurality of feeder means past each of the stacks of sheet material in turn.

2. An apparatus as set forth in claim 1 wherein each of said feeder means is operable to feed sheet material to only one of said receiving locations.

3. An apparatus as set forth in claim 1 wherein one of said feeder means is operable to feed sheet material to one of said receiving locations from each stack of the plurality of stacks of sheet material during movement of the one feeder means and receiving location past each of the stacks of sheet material in turn.

4. An apparatus as set forth in claim 3 wherein said means for sequentially moving said plurality of feeder means past each of the stacks of sheet material in turn includes means for moving each one of said feeder means along with the one of said receiving locations to which the one of said feeder means feeds sheet material past each of the stacks of sheet material in turn.

5. An apparatus as set forth in claim 3 wherein each of said feeder means is operable to feed sheet material to only one of said receiving locations.

6. An apparatus as set forth in claim 1 wherein each of said feeder means includes guide surface means for cooperating with a next preceeding feeder means to guide movement of sheet material being fed by the next preceeding feeder means to a receiving location.

7. An apparatus as set forth in claim 1 further including a plurality of surfaces each of which is disposed at one of said receiving locations, and a plurality of rotatable brush means for pressing sheet material against said surfaces.

8. An apparatus as set forth in claim 1 wherein said plurality of receiving locations include means for forming a plurality of pockets having upper end portions and lower end portions which are operable between open and closed conditions, said feeder means being operable to feed sheet material from the stacks of sheet material into said pockets through the open upper end portions of said pockets, said lower end portions of said pockets being operable from the closed condition to the open condition to enable sheet material to move out of said pockets.

9. An apparatus as set forth in claim 1 wherein said plurality of feeder means includes surface means for supporting the plurality of stacks of sheet material, said surface means being movable with said plurality of feeder means past each of the stacks of sheet material in turn.

10. A method of forming sheet material assemblages, said method comprising the steps of supporting a plurality of stacks of sheet material on a plurality of belts by engaging the stacks of sheet material with the belts, sequentially supporting the stacks of sheet material on different belts of the plurality of belts by moving the belts relative to the stacks of sheet material, and feeding sheet material from the stacks of sheet material along paths extending between the belts as the plurality of belts move relative to the stacks of sheet material.

11. A method as set forth in claim 10 further including the step of maintaining portions of the belts engaging the the stacks of sheet material stationary relative to the stacks of sheet material during movement of the belts relative to the stacks of sheet material.

12. A method as set forth in claim 11 wherein said step of maintaining the portions of the belts engaging the stacks of sheet material stationary relative to the stacks of sheet material includes changing the portions of the belts engaging the stacks of sheet material during movement of the plurality of belts relative to the stacks of sheet material.

13. A method as set forth in claim 12 further including maintaining the stacks of sheet material stationary relative to a base during performance of said step of supporting a plurality of stacks of sheet material on a plurality of belts, said step of changing the portions of the belts engaging the stacks of sheet material includes driving the plurality of belts under the influence of force transmitted from the stationary base to the belts through drive elements which roll along the base.

14. A method as set forth in claim 10 wherein each of the belts has a generally horizontal upper run, said step of moving the plurality of belts relative to the stacks of sheet material includes moving a portion of the upper run of each of the belts in turn into engagement with, across and out of engagement with a lower end portion of a stack of sheet material.

15. A method as set forth in claim 10 wherein each of the belts has an upper run, said step of moving the belts relative to the stacks of sheet material includes moving trailing end portions of the upper run of each of the belts in turn across and out of engagement with each of the stacks of sheet material in turn, said step of feeding sheet material from the stacks of sheet material includes feeding sheet material downwardly across the trailing end portion of the upper run of one of the belts as the trailing end portion of the upper run of the one belt moves across a lower end portion of a stack of sheet material.

16. A method as set forth in claim 10 wherein said step of feeding sheet material from the stacks of sheet material includes moving a plurality of grippers relative to the stacks of sheet material with the plurality of belts, sequentially engaging lower layers of sheet material in the stacks of sheet material with the grippers, moving edge portions of lower layers of sheet material engaged by the grippers away from the stacks of sheet material and downwardly into the path of movement of the belts, and pressing against the lower layers of sheet material to disengage the lower layers of sheet material from the stacks of sheet material as the belts move relative to the stacks of sheet material.

17. A method as set forth in claim 16 wherein said step of sequentially engaging lower layers of sheet material in the stacks of sheet material with the grippers includes engaging a lower layer of sheet material in each of the stacks of sheet material in turn with each of the grippers.

18. A method as set forth in claim 10 wherein said step of moving the belts relative to the stacks of sheet material includes moving the belts along a path having linear and nonlinear sections with a first belt leading a second belt, and changing the distance between the first and second belts as they move between the linear and nonlinear sections of the path.

19. A method as set forth in claim 18 wherein said step of changing the distance between the first and second belts includes increasing the distance between the first and second belts as they move from a linear section of the path to a nonlinear section of the path and decreasing the distance between the first and second belts as they move from a nonlinear section of the path to a linear section of the path.

20. A method as set forth in claim 10 wherein said step of moving the plurality of belts relative to the stacks of sheet material includes moving the belts along a continuous path, said step of moving the belts along a continuous path includes moving the belts at a first speed relative to the stacks of sheet material as the belts move along a first section of the continuous path and moving the belts at a second speed which is greater than the first speed as the belts move along a second section of the continuous path.

21. A method as set forth in claim 10 wherein said step of feeding sheet material from the stacks of sheet material includes moving the sheet material to receiving locations, and pressing the sheet material against locating surfaces at the receiving locations by brushing against the sheet material with a plurality of flexible bristles.

22. A method of forming sheet material assemblages, said method comprising the steps of providing a plurality of stacks of sheet material, sequentially moving a plurality of receiving locations past each of the stacks of sheet material in turn, sequentially moving a plurality of feeder means past each of the stacks of sheet material in turn, and feeding sheet material from each stack of the plurality of stacks of sheet material to the receiving locations with the feeder means.

23. A method as set forth in claim 22 wherein said step of feeding sheet material from each stack of the plurality of stacks of sheet material to the receiving locations with the feeder means includes feeding to only one of the receiving locations with each of the feeder means.

24. A method as set forth in claim 22 wherein said step of feeding sheet material from each stack of the plurality of stacks of sheet material to the receiving locations with the feeder means includes sequentially feeding sheet material from each of the stacks of sheet material to one of the receiving locations with one of the feeder means during movement of the one feeder means and receiving location past each of the stacks of sheet material in turn.

25. An apparatus for forming sheet material assemblages, said apparatus comprising means for holding a plurality of stacks of sheet material, a plurality of receiving locations, means for sequentially moving said receiving locations past each of the stacks of sheet material in turn, a plurality of feeder means for feeding sheet material from the stacks of sheet material to the receiving locations, each of said feeder means being operable to feed sheet material from each stack of the plurality of stacks of sheet material, and means for sequentially moving said plurality of feeder means past each of the stacks of sheet material in turn, said plurality of feeder means including surface means for supporting the plurality of stacks of sheet material, said surface means being movable with said plurality of feeder means, and means for moving said surface means at a speed which is equal to the speed of movement of said feeder means and in a direction opposite to the direction of movement of said feeder means to prevent slippage between said surface means and the stacks of sheet material.

26. An apparatus as set forth in claim 25 wherein one of said feeder means is operable to feed sheet material to one of said receiving locations from each stack of the plurality of stacks of sheet material during movement of the one feeder means and receiving location past each of the stacks of sheet material in turn.

27. An apparatus as set forth in claim 26 wherein each of said feeder means is operable to feed sheet material to only one of said receiving locations.

28. An apparatus as set forth in claim 27 wherein said means for sequentially moving said plurality of feeder means past each of the stacks of sheet material in turn includes means for moving each one of said feeder means along with the one of said receiving locations to which the one of said feeder means feeds sheet material.

29. An apparatus as set forth in claim 25 wherein each feeder means of said plurality of feeder means is movable along a continuous path past each receiving location of said plurality of receiving locations, each of said feeder means being operable to feed sheet material from each of the stacks of sheet material during movement of said feeder means along the continuous path.

30. An apparatus as set forth in claim 29 wherein said plurality of receiving locations are movable along the continuous path with said plurality of feeder means, each of said feeder means being operable to feed sheet material from each of the stacks of sheet material to one of said receiving locations during movement of said feeder means and said receiving locations along the continuous path.

31. An apparatus as set forth in claim 25 wherein said plurality of feeder means includes a plurality of belts, said surface means being at least partially formed by side surfaces of said belts.

32. An apparatus as set forth in claim 31 wherein one belt of said plurality of belts moves from a location engaging a first one of the stacks of sheet material to a location engaging a second one of the stacks of sheet material during movement of one of said feeder means from a location adjacent to the first stack of sheet material to a location adjacent to the second stack of sheet material.

33. An apparatus for forming sheet material assemblages, said apparatus comprising means for holding a plurality of stacks of sheet material, a plurality of receiving locations, means for sequentially moving said receiving locations past each of the stacks of sheet material in turn, a plurality of feeder means for feeding sheet material from the stacks of sheet material to the receiving locations, each of said feeder means being operable to feed sheet material from each stack of the plurality of stacks of sheet material, and means for sequentially moving said plurality of feeder means past each of the stacks of sheet material in turn, each of said feeder means including a driven belt having an upper run which is sequentially engageable with each of the stacks of sheet material in turn and which moves in a direction opposite to the direction of movement of said feeder means and at the same speed as said feeder means.

34. An apparatus for forming sheet material assemblages, said apparatus comprising means for holding a plurality of stacks of sheet material, a plurality of receiving locations, means for sequentially moving said receiving locations past each of the stacks of sheet material in turn, a plurality of feeder means for feeding sheet material from the stacks of sheet material to the receiving locations, each of said feeder means being operable to feed sheet material from each stack of the plurality of stacks of sheet material, and means for sequentially moving said plurality of feeder means past each of the stacks of sheet material in turn, said plurality of feeder means being movable along a continuous path having a linear section, said feeder means being operable to feed sheet material from at least some of the stacks of sheet material during movement of said feeder means along the linear section of the continuous path.

35. An apparatus as set forth in claim 34 wherein each of said feeder means is operable to feed sheet material to only one of said receiving locations.

36. An apparatus as set forth in claim 34 wherein one of said feeder means is operable to feed sheet material to one of said receiving locations from each stack of the plurality of stacks of sheet material during movement of the one feeder means and receiving location past each of the stacks of sheet material in turn.

37. An apparatus as set forth in claim 36 wherein each of said feeder means is operable to feed sheet material to only one of said receiving locations.

38. An apparatus as set forth in claim 36 wherein said means for sequentially moving said plurality of feeder means past each of the stacks of sheet material in turn includes means for moving each one of said feeder means along with the one of said receiving locations to which the one of said feeder means feeds sheet material.

39. An apparatus as set forth in claim 34 wherein said plurality of feeder means includes surface means for supporting the plurality of stacks of sheet material, said surface means being movable with said plurality of feeder means.

40. An apparatus as set forth in claim 39 wherein said plurality of feeder means includes means for moving said surface means at a speed which is equal to the speed of movement of said feeder means and in a direction opposite to the direction of movement of said feeder means to prevent slippage between surface means and the stacks of sheet material.

41. An apparatus as set forth in claim 34 wherein said plurality of receiving locations are movable along the continuous path with said plurality of feeder means, said feeder means being operable to feed sheet material to said receiving locations during movement of said receiving locations along the linear section of the continuous path.

42. An apparatus as set forth in claim 41 wherein said means for moving said receiving locations and said means for moving said feeder means are operable to move said feeder means and said receiving locations in the same direction and at the same speed along the continuous path.

43. A method of forming sheet material assemblages, said method comprising the steps of providing a plurality of stacks of sheet material, sequentially moving a plurality of receiving locations past each of the stacks of sheet material in turn, sequentially moving a plurality of feeder means past each of the stacks of sheet material in turn, feeding sheet material from each stack of the plurality of stacks of sheet material to the receiving locations with the feeder means, and supporting the plurality of stacks of sheet material on surface means, said step of sequentially moving the plurality of feeder means past each of the stacks of sheet material in turn includes moving the surface means supporting the plurality of stacks of sheet material with the plurality of feeder means.

44. A method as set forth in claim 43 wherein said step of sequentially moving a plurality of feeder means past each of the stacks of sheet material in turn includes moving the plurality of the feeder means and the surface means along a continuous path, said step of feeding sheet material from each stack of the plurality of stacks including feeding sheet material from at least some of the stacks of sheet material during movement of the feeder means along the continuous path while supporting at least some of the stacks of sheet material on the surface means.

45. A method as set forth in claim 43 wherein said step of sequentially moving a plurality of receiving locations past each of the stacks of sheet material in turn includes moving the receiving locations along a continuous path with said plurality of feeder means and said surface means, and feeding sheet material to the receiving locations as the receiving locations move along the continuous path.

46. A method as set forth in claim 43 wherein said step of feeding sheet material from each stack of the plurality of stacks of sheet material to the receiving locations with the feeder means includes feeding sheet material to only one of the receiving locations with each of the feeder means.

47. A method as set forth in claim 43 wherein said step of feeding sheet material from each stack of the plurality of stacks of sheet material to the receiving locations with the feeder means includes sequentially feeding sheet material from each of the stacks of sheet material to one of the receiving locations with one of the feeder means during movement of the one feeder means and receiving location past each of the stacks of sheet material in turn.

48. A method as set forth in claim 43 further including moving portions of the surface means engaging the stacks of material in directions opposite to the directions of movement of the feeder means and at a speed which is equal to the speed of movement of the feeder means to eliminate slippage between the surface means and the stacks of sheet material.

49. A method of forming sheet material assemblages, said method comprising the steps of providing a plurality of stacks of sheet material, sequentially moving a plurality of receiving locations past each of the stacks of sheet material in turn, sequentially moving a plurality of feeder means past each of the stacks of sheet material in turn, feeding sheet material from each stack of the plurality of stacks of sheet material to the receiving locations with the feeder means, and at least partially supporting each of the stacks of sheet material in turn by sequentially engaging an upper run of a belt with each of the stacks of sheet material and moving the upper run of the belt in a direction opposite to the direction of movement of the feeder means and at the same speed as the feeder means.

50. A method of forming sheet material assemblages, said method comprising the steps of providing a plurality of stacks of sheet material, sequentially moving a plurality of receiving locations past each of the stacks of sheet material in turn, sequentially moving a plurality of feeder means past each of the stacks of sheet material in turn, feeding sheet material from each stack of the plurality of stacks of sheet material to the receiving locations with the feeder means, said step of sequentially moving a plurality of feeder means past each of the stacks of sheet material in turn includes moving the plurality of the feeder means along a continuous path having a linear section, and feeding sheet material from at least some of the stacks of sheet material during movement of the feeder means along the linear section of the continuous path.

51. A method as set forth in claim 50 wherein said step of feeding sheet material from each stack of the plurality of stacks of sheet material to the receiving locations with the feeder means includes feeding to only one of the receiving locations with each of the feeder means.

52. A method as set forth in claim 50 wherein said step of feeding sheet material from each stack of the plurality of stacks of sheet material to the receiving locations with the feeder means includes sequentially feeding sheet material from each of the stacks of sheet material to one of the receiving locations with one of the feeder means during movement of the one feeder means and receiving location past each of the stacks of sheet material in turn.

53. A method as set forth in claim 50 further including the step of supporting the plurality of stacks of sheet material on surface means, said step of sequentially moving the plurality of feeder means past each of the stacks of sheet material in turn includes moving the surface means supporting the plurality of stacks of sheet material with the plurality of feeder means.

54. A method as set forth in claim 53 further including moving portions of the surface means engaging the stacks of sheet material in directions opposite to the direction of movement of the feeder means and at a speed which is equal to the speed of movement of the feeder means to eliminate slippage between the surface means and the stacks of sheet material.

55. A method as set forth in claim 50 further including at least partially supporting each of the stacks of material in turn by sequentially engaging an upper run of a belt with each of the stacks of sheet material and moving the upper run of the belt in a direction opposite to the direction of movement of the feeder means and at the same speed as the feeder means.

56. A method as set forth in claim 50 wherein said step of sequentially moving a plurality of receiving locations past each of the stacks of sheet material in turn includes moving the receiving locations along the continuous path with said plurality of feeder means, and feeding sheet material to the receiving locations as the receiving locations move along the linear section of the continuous path.

57. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, and drive means for moving said plurality of support elements to maintain portions of said support elements engaging lower end portions of the stacks of sheet material in said bottomless hopper means stationary relative to said bottomless hopper means as said plurality of support elements move relative to said bottomless hopper means.

58. An apparatus as set forth in claim 57 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

59. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, each support element of said plurality of support elements includes a belt having a generally horizontal run with a leading end portion, said means for moving said plurality of support elements including means for moving leading end portions of said horizontal runs of said belts into engagement with and across lower end portions of the stack of sheet material disposed in said bottomless hopper means.

60. An apparatus as set forth in claim 59 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

61. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, and means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, each support element of said plurality of support elements includes a belt having an upper run with a trailing end portion, said means for moving said plurality of support elements including means for moving trailing end portions of said upper runs of said belts across and out of engagement with the lower end portions of each of the stacks of sheet material in turn, said upper run of each belt including surface means for engaging sheet material as it is fed from the lower end portions of the stacks of sheet material and moves downwardly between adjacent belts as said trailing end portion of said upper run of one belt moves across the lower end portion of a stack of sheet material.

62. An apparatus as set forth in claim 61 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

63. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, said means for feeding sheet material includes a plurality of grippers, said means for moving said plurality of support elements including means for moving said plurality of grippers relative to the stacks of sheet material with the plurality of support elements, said grippers being movable to sequentially engage edge portions of sheet material in the stacks of sheet material to move the edge portions downwardly means movable with the support elements relative to the stacks of sheet material, said surface means being engageable with sheet material to disengage the sheet material from the stacks of sheet material as the support elements move relative to the stacks of sheet material.

64. An apparatus as set forth in claim 63 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

65. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, said plurality of support elements being movable relative to the stacks of sheet material along a path having linear and nonlinear sections, said plurality of support elements including a first support element which leads a second support element, the distance between the first and second support elements changing between said linear and nonlinear sections of said path as said plurality of support elements move along said path.

66. An apparatus as set forth in claim 65 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

67. An apparatus for forming sheet material assemblages, said apparatus comprising a plurality of bottomless hopper means for receiving a plurality of stacks of sheet material, support means for supporting the stacks of sheet material disposed in said plurality of bottomless hopper means, said support means including a plurality of support elements, means for moving said plurality of support elements relative to said plurality of bottomless hopper means to sequentially engage lower end portions of the stacks of sheet material disposed in said plurality of bottomless hopper means with each support element of said plurality of support elements, means for feeding sheet material from lower end portions of the plurality of stacks of sheet material disposed in said plurality of bottomless hopper means along paths extending between adjacent support elements of said plurality of support elements as said plurality of support elements move relative to said plurality bottomless hopper means, each support element being movable relative to the stacks of sheet material along a continuous path, said support elements move along said continuous path at a first speed along a first section of said continuous path and at a second speed, which is greater than said first speed, as said support elements move along a second section of said continuous path.

68. An apparatus as set forth in claim 67 further including a plurality of receiving locations, said means for moving said plurality of support elements relative to said bottomless hopper means including means for sequentially moving said plurality of receiving locations past said bottomless hopper means, said means for feeding sheet material from lower end portions of stacks of sheet material disposed in said bottomless hopper means being operable to feed sheet material from each stack of the plurality of stacks of sheet material to the receiving locations.

* * * * *

UNITED STATES PATENT AND TRADEMARK OFFICE

CERTIFICATE OF CORRECTION

PATENT NO. : 4,988,086

DATED : January 29, 1991

INVENTOR(S) : James R. Schlough

It is certified that error appears in the above-identified patent and that said Letters Patent is hereby corrected as shown below:

Column 19, Line 58, Claim 59, insert --and-- after "elements, ".

Column 21, Line 15, Claim 63, insert --into the path of movement of said support elements, and surface-- after "downwardly".

Signed and Sealed this

Thirtieth Day of June, 1992

*Attest:*

DOUGLAS B. COMER

*Attesting Officer*

*Acting Commissioner of Patents and Trademarks*